US011174542B2

(12) United States Patent
Harrison et al.

(10) Patent No.: US 11,174,542 B2
(45) Date of Patent: Nov. 16, 2021

(54) HIGH VOLUME MANUFACTURING METHOD FOR FORMING HIGH STRENGTH ALUMINUM PARTS

(71) Applicant: Ford Motor Company, Dearborn, MI (US)

(72) Inventors: Nia Harrison, Ann Arbor, MI (US); S. George Luckey, Jr., Dearborn, MI (US); Elizabeth Bullard, Royal Oak, MI (US)

(73) Assignee: Ford Motor Company, Dearborn, MI (US)

( * ) Notice: Subject to any disclaimer, the term of this patent is extended or adjusted under 35 U.S.C. 154(b) by 419 days.

(21) Appl. No.: 15/900,004

(22) Filed: Feb. 20, 2018

(65) Prior Publication Data

US 2019/0256958 A1 Aug. 22, 2019

(51) Int. Cl.

| | |
|---|---|
| ***C22F 1/047*** | (2006.01) |
| ***B21D 22/02*** | (2006.01) |
| ***C22F 1/00*** | (2006.01) |

(52) U.S. Cl.

CPC ..... *C22F 1/047* (2013.01); *B21D 22/02* (2013.01); *C22F 1/002* (2013.01)

(58) Field of Classification Search

CPC .. C22F 1/04; C22F 1/043; C22F 1/047; C22F 1/05; C22F 1/053; C22F 1/057; B21D 22/02; B21D 22/022

See application file for complete search history.

(56) References Cited

U.S. PATENT DOCUMENTS

| | | | | |
|---|---|---|---|---|
| 8,496,764 | B2 | 7/2013 | Luckey et al. | |
| 8,826,712 | B1 * | 9/2014 | Luckey, Jr. ..... | B21D 26/033 72/58 |
| 2012/0073347 | A1 * | 3/2012 | Luckey ..... | B21D 37/16 72/324 |

(Continued)

FOREIGN PATENT DOCUMENTS

| | | |
|---|---|---|
| CN | 106583489 | 4/2017 |

OTHER PUBLICATIONS

Meiler et al., "Lubrication of Aluminium Sheet Metal within the Automotive Industry" (2005), Advanced Materials Research, vols. 6-8, p. 551-558, doi:10.4028/www.scientific.net/AMR.6-8.551 (Year: 2005).*

(Continued)

*Primary Examiner* — Patricia L. Hailey
*Assistant Examiner* — Christopher D. Moody
(74) *Attorney, Agent, or Firm* — Burris Law, PLLC

(57) ABSTRACT

The present disclosure is generally directed toward a high volume manufacturing method for forming high strength aluminum parts. The method includes acquiring material blanks that are made of 7xxx series aluminum alloy, heating the blanks to a solvus temperature of the material, and stamping and quenching the heated blanks to form multiple parts. The parts are cooled to a second temperature lower than the solvus temperature during the quenching operation. The method further includes performing one or more structural modifications of the parts within a set time period that is less than or equal to 24 hours. The method further includes racking the parts with a gap defined between two adjacent parts, artificially aging the parts with an industrial oven, and pretreating the parts with a chemical solution.

10 Claims, 4 Drawing Sheets

(56) References Cited

U.S. PATENT DOCUMENTS

| | | | |
|---|---|---|---|
| 2015/0101718 | A1 | 4/2015 | Harrison et al. |
| 2016/0030992 | A1 | 2/2016 | Clarke et al. |
| 2016/0339497 | A1 | 11/2016 | Sachdev et al. |
| 2017/0101706 | A1 | 4/2017 | Bassi et al. |
| 2017/0183762 | A1 | 6/2017 | Inoue et al. |
| 2017/0253941 | A1 | 9/2017 | Cobo et al. |

OTHER PUBLICATIONS

Kumar, M., Ross, N.G., Investigations on the Hot Stamping of AW-7921-T4 Alloy Sheet, Jan. 2017, available at URL http://www.researchgate.net/publication/314083916_Investigations_on_the_Hot_Stamping_of_AW-7921-T4_Alloy_Sheet.

* cited by examiner

HIGH VOLUME MANUFACTURING METHOD FOR FORMING HIGH STRENGTH ALUMINUM PARTS

FIELD

The present disclosure relates to a method for high volume manufacturing of stamped metal parts.

BACKGROUND

The statements in this section merely provide background information related to the present disclosure and may not constitute prior art.

The various industries, such as the automobile and aerospace industries, are moving away from heavy materials, such as steel, to lighter materials like 5xxx and 6xxx series aluminum alloys, which can be formed or shaped using methods similar to those of steel.

Aluminum alloys are generally identified using the International Alloy Designation System in which each alloy is given a four-digit number. The first digit indicates the major alloying elements. If the second digit is not zero, the digit indicates a variation of the alloy, and the third and fourth digits identify the specific alloy in the series. For example, a 5xxx series alloy is alloyed with magnesium and a 6xxx series alloy is alloyed with magnesium and silicon.

Aluminum alloy of the 7xxx series are alloyed with zinc and have strengths similar to high and ultra-high strength steel. However, the 7xxx series alloy are not as formable at room temperature in comparison to mild steels or other classes of aluminum alloys and thus, can be difficult to implement in high volume manufacturing. This and other issues are addressed by the teachings of the present disclosure.

SUMMARY

This section provides a general summary of the disclosure, and is not a comprehensive disclosure of its full scope or all of its features.

In one form, the present disclosure is directed toward a high volume manufacturing method for forming high strength aluminum parts. The method includes acquiring material blanks, and heating, with a first industrial oven, the blanks to a solvus temperature of the material. The method further includes stamping and quenching the heated blanks to form a plurality of parts, and the parts are cooled to a second temperature lower than the solvus temperature. The method further includes performing one or more structural modifications of the plurality of parts within a set time period subsequent of the stamping and quenching of the heated material blanks. The set time period is set is less than or equal to 24 hours. The method further includes racking the plurality of parts with a gap defined between two adjacent parts, artificially aging the plurality of parts with a second industrial oven, and pretreating the plurality of parts with a chemical.

In another form, the performing one or more structural modifications of the plurality of parts is at room temperature.

In yet another form, the method further includes performing a low temperature aging of the plurality of parts prior to performing the one or more structural modifications.

In one form, the one or more structural modifications includes at least one of trimming, piercing, and bending the plurality of parts.

In another form, the method further includes having a plurality of machines positioned in series for the stamping and quenching of the heated materials, and for the one or more structural modifications of the plurality of parts.

In yet another form, the one or more structural modifications is completed within 8 hours after the stamping and quenching of the material blanks.

In one form, the method further includes cleansing the plurality of parts prior to the artificially aging the plurality of parts.

In another form, the heating the blanks to a solvus temperature further includes transferring the material blanks to one or more ovens.

In yet another form, the stamping and quenching, the performing one or more structural modifications, and the racking the plurality of parts are completed within 24-hours.

In one form, the material blanks are made of 7xxx series aluminum alloy.

In one form, the present disclosure is directed toward a high volume manufacturing method for forming high strength aluminum parts. The method includes destacking a batch of material blanks that are made of 7xxx series aluminum alloy, heating the material blanks to a solvus temperature of the material blanks, and stamping and quenching the heated material blanks to form a plurality of parts. The parts are cooled to a second temperature lower than the solvus temperature. The method further includes performing one or more structural modifications of the plurality of parts within a set time period subsequent of the stamping and quenching of the heated material blanks, where the set time period is less than or equal to 24-hours. The method further includes cleansing the plurality of parts to remove foreign matter, artificially aging the plurality of parts with an industrial oven, and pretreating the plurality of parts in a chemical solution.

In another form, the method further includes buffering the plurality of parts in a staging area prior to the artificial aging of the plurality of parts.

In yet another form, the method further includes performing a low temperature aging of the plurality of parts prior to performing the one or more structural modifications.

In one form, the one or more structural modifications comprises at least one of trimming and piercing the plurality of parts.

In another form, the one or more structural modifications is completed within 8-hours after the stamping and quenching of the material blanks.

In yet another form, the method further includes transferring, by way of a first automated machine, at least one blank at a time to a stamping press for the stamping and quenching of the heater blanks, serially transferring, by way of a second automated machine, one part at a time from the stamping machine to one or more part formation machine to perform the one or more structural modifications, and racking the parts from the one or more structural modifications with a gap defined between two adjacent parts In one form, the stamping and quenching, the performing the one or more structural modifications, and the racking the plurality of parts are completed within 24-hours.

In one form, the present disclosure is directed toward a hot stamping method for high volume manufacturing. The method includes acquiring material blanks that are of 7xxx series aluminum, solution heating the blanks to a solvus temperature of the material, stamping and quenching the heated batch to form multiple parts, serially forming, by multiple machines positioned in series, multiple features on the parts within, at most, 24-hours of the stamping and quenching, artificially aging the parts, and pretreating the parts with a chemical solution.

In another form, the serially forming the at least one feature is completed within 8-hours after the stamping and quenching of the material blanks.

In yet another form, the method further includes racking the parts in a fixture with a gap defined between two adjacent parts after the one or more structural modifications.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
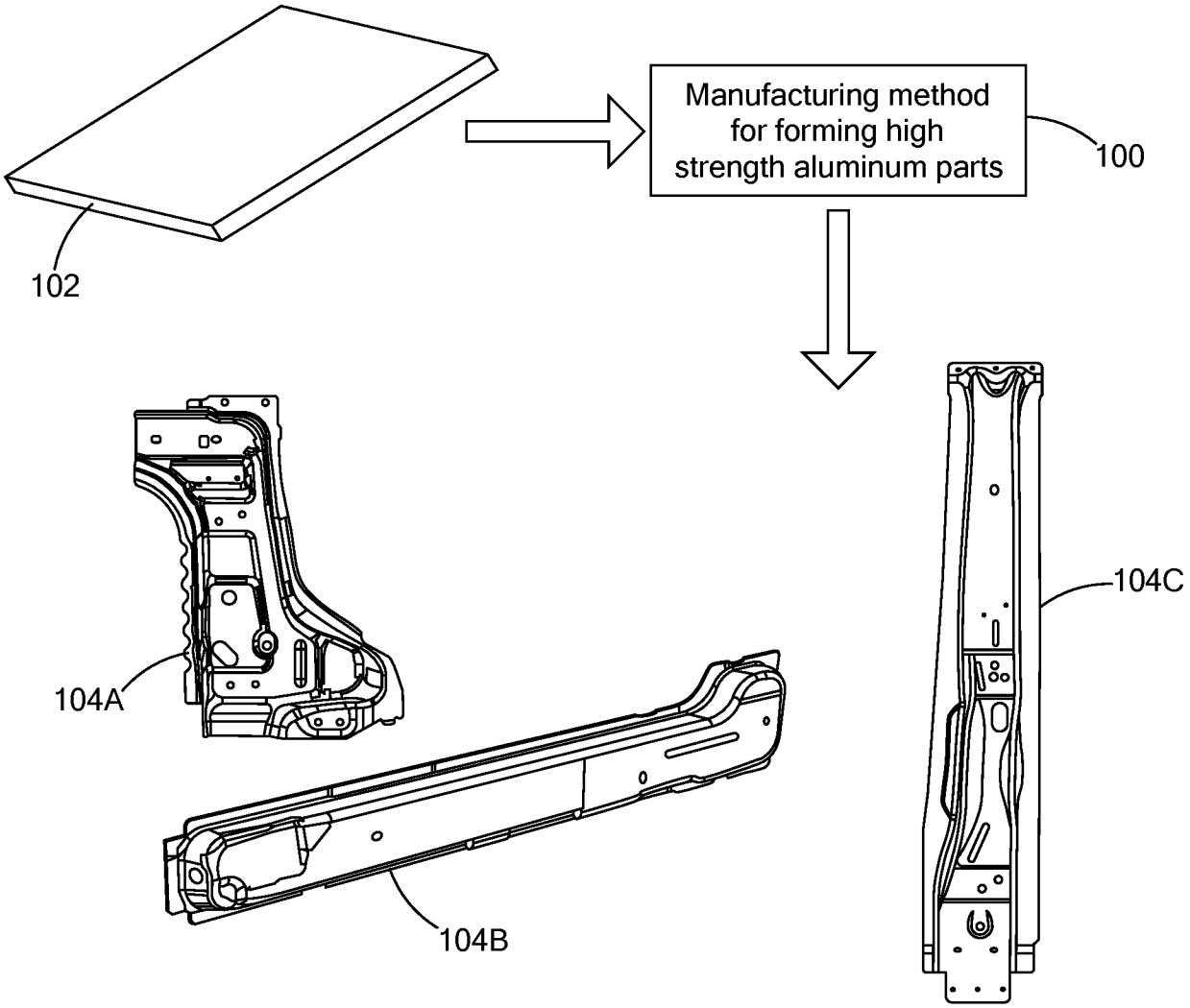
FIG. 1 illustrates multiple stamped parts formable from a 7xxx series aluminum alloy in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, the present disclosure is generally directed toward a high volume manufacturing method 100 that transforms a blank 102 made of a 7xxx series aluminum alloy to a high strength aluminum part, such as a hinge pillar 104A, a side sill reinforcement 104B, B-pillar reinforcement 104C, or other suitable part. The high volume manufacturing method incorporates solution heat treatment of the blank 102, a quenching process to stamp and rapidly reduce the temperature of the blank 102, and a series of structural modification to form additional features on the part within a specific time period defined by the formability characteristics of the material. The method described herein outlines a value stream process for hot stamping 7xxx series aluminum alloy that may be implemented in various manufacturing industries, such as automobile and aerospace. The method may be implemented to form a variety of components, such as a B-pillar, rocker, hinger pillar, and parts within an assembly like a seat frame requiring strength and load carrying capacity.

Figure 2:
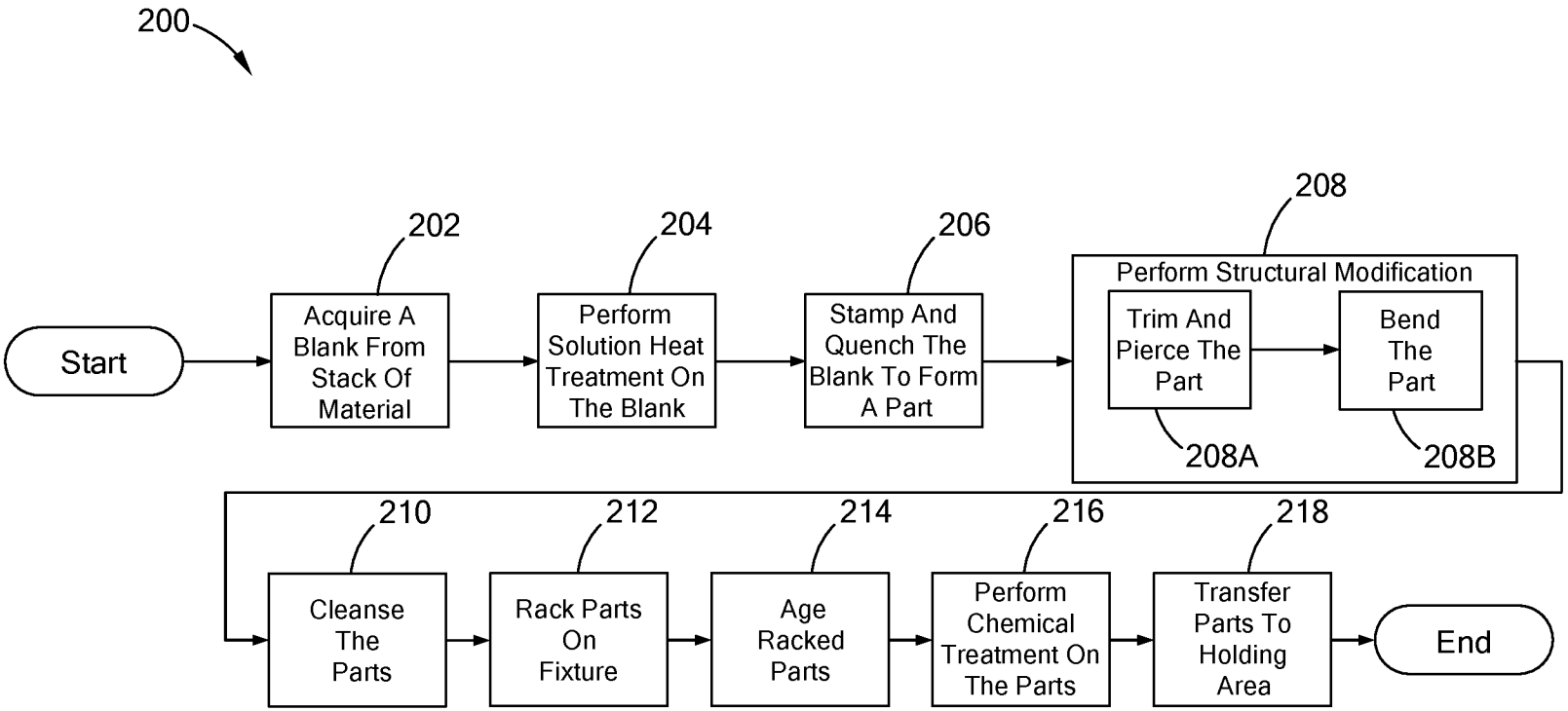
FIG. 2 is a flowchart of a high volume manufacturing routine for forming high strength aluminum parts from a 7xxx series aluminum alloy blank in accordance with the teachings of the present disclosure.

Referring to FIG. 2, an example high volume manufacturing routine 200 for forming parts from 7xxx series aluminum alloy blanks is provided. At 202, one or more blanks are acquired from a stack of blanks, and at 204, the blanks undergo a solution heat treatment. That is, to form stamped parts out of the 7xxx series aluminum alloy, the blank undergoes a heating process, such as a solution heat treatment, before being stamped. For example, U.S. Pat. No. 8,496,764, which is incorporated herein by reference, outlines a system and method for forming a blank out of a fabricated (F-temper) 7xxx series aluminum alloy. The method outlined provides that a blank made of a 7xxx series aluminum alloy is heated via a heating apparatus (e.g., an industrial oven) to a predetermined temperature, such as a solution temperature or solidus temperature. The solution temperature for a 7xxx series aluminum alloy is approximately 460° C. to 490° C., a temperature range at which strengthening solute is in solution (single phase). The solidus temperature is a particular temperature on a curve of a phase diagram below which the material is completely solid. At the solidus temperature, the material being heated is between solid and liquid phases, and thus, is solid to promote handling of the blank and formable due to its liquid or partial liquid properties. In one form for AA7075, the solution heat treatment is a range of temperature above the solvus temperature, between 460° C. and 490° C., such that the blank is heated to single phase field, but maintained below the solidus temperature, in this case 490° C., to prevent insipient melting. Both solvus and solidus are alloy chemistry dependent temperatures. Generally, a solvus is a line on a phase diagram that separates homogeneous solid state of the material from a lower temperature unstable state of multiple phases.

After being heated, the routine 200 proceeds to 206, at which the blank is transferred to a die set or, in other words, a stamping press that simultaneously stamps and quenches the heated blank to form a part. In one form, as described in U.S. Pat. No. 8,496,764, the stamping press includes a staging apparatus that positions the blank between and spaced apart from the dies and inhibits conductive heat transfer between the blank and dies. In one form, the stamping press is a standard hydraulic press. In another form, the stamping press is a servo mechanical press with servo-valve controlled hydraulic cushion for quench control. The ram of a servo mechanical press is driven by electric servo motors providing dynamic and fine control of main ram speed and position through the stroke. The main ram moves to upper half of the die. The lower half of the die can be pushed up with a controlled force opposing the upper ram. This can enable control of forming and quenching pressures. A servo-valve controlled hydraulic cushion enables the dynamic control of cushion force through the entire press stroke. This system enables dynamic control of position and pressure for hot stamping to optimize press cycle time and control the quench through the stroke. The blanks are cooled to, for example, room temperature by way of the dies of the stamping press. The stamping press speed of travel is between 200 mm/s and free fall in order to maximize the rate of cooling, so as to ensure that the desired final temper strength and corrosion performance characteristics of the part are achieved. For example, the blank may be cooled at a first quench rate that is greater than or equal to 150° C./second as it cools from 400° C. to 290° C., and then at a second quench rate (e.g. 50° C./second) as it cools to the final temperature (e.g. 25° C.).

Figure 3A:
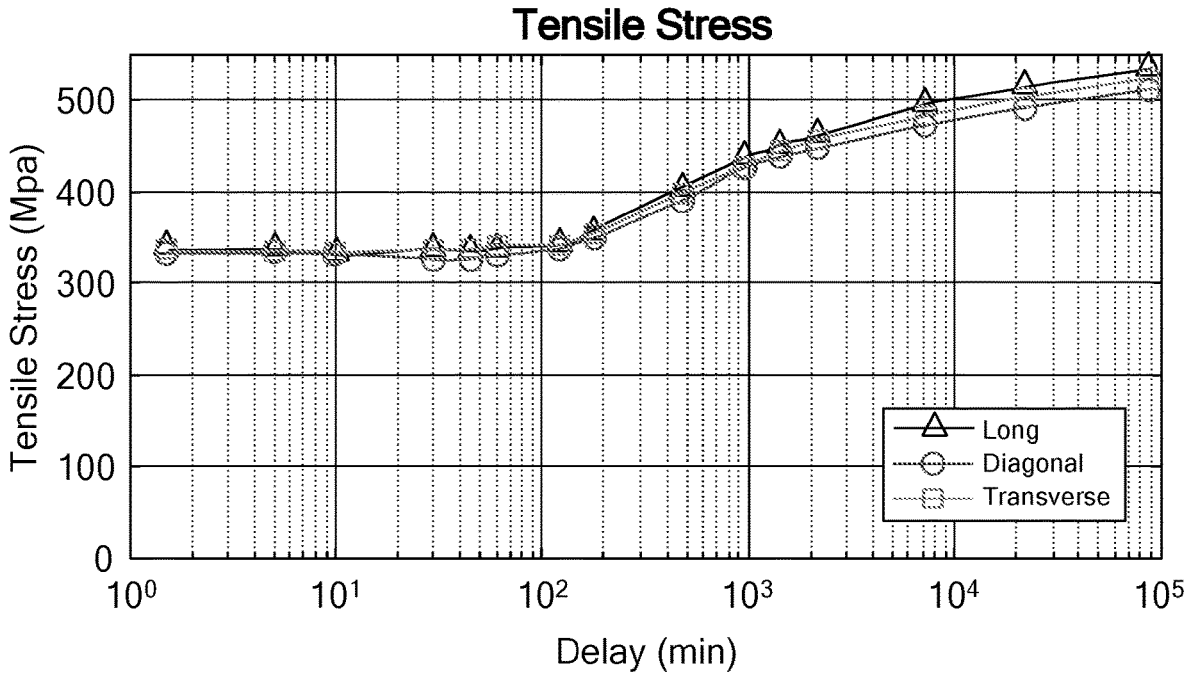
FIGS. 3A and 3B are graphs of an expected tensile stress and yield stress of a stamped and quenched part in accordance with the teachings of the present disclosure.
Figure 3B:
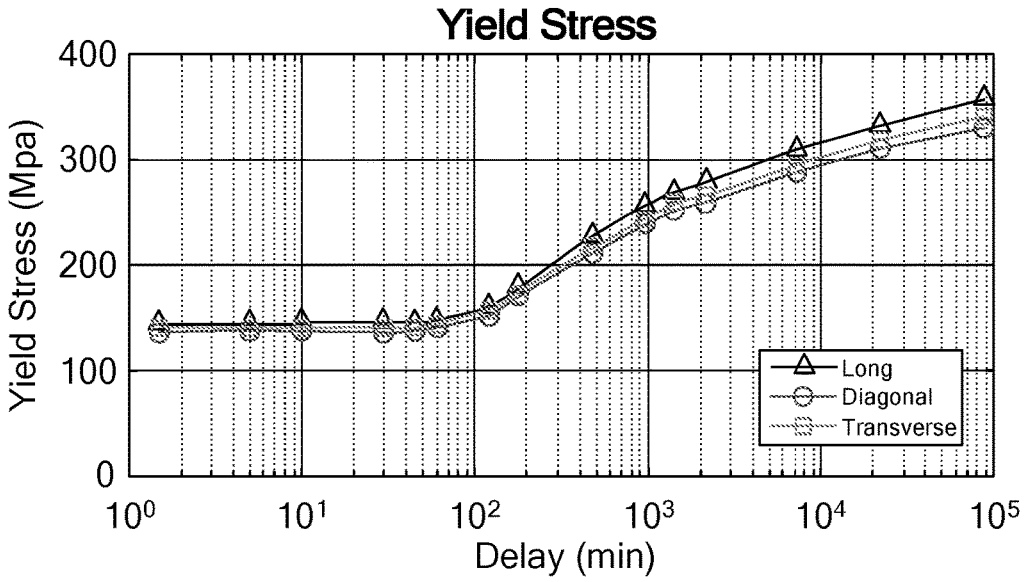

After stamping-quenching, the routine 200 proceeds to 208 at which one or more structural modifications are performed within a set-time period. More particularly, the stamped part begins to age with time (i.e., natural aging) such that the yield strength and ultimate tensile strength begins to increase, and thus becomes less formable as time passes. For example, FIGS. 3A and 3B illustrate expected tensile stress and yield stress of a 2-milimeter 7075 aluminum alloy sample after quenching, respectively. The tensile and yield stresses of the sample initial undergoes little to no change, and then, after about 100-minutes the stresses begin to increase indicating the material is becoming less formable. Accordingly, in forming parts of 7xxx series aluminum, any subsequent structural modifications, in which one or more features are formed on the part, is to be completed within a set time period defined by the formable characteristics of the material (i.e., a formability time period). For example, in one form, the set time period is less than or equal to 24 hours after stamping and quenching. In another form, the set time period is less than or equal to 8-hours after stamping and quenching.

In one form, the subsequent structural modifications are performed at room temperature and include one or more cutting operations, such as trimming and piercing, and/or a bending operation. For example, FIG. 2 includes a trimming and/or piercing operation, at 208A, and a bending operation, at 208B. The structural modifications may be performed using one or more machines (e.g., die flanging, trim tool, piercing tool, secondary die stamping, etc.) that are arranged in series with the stamping press to minimize delays in forming the parts. Other suitable operations in which the parts undergo structural modifications may also be implemented as part of the method for creating the part as long as the modifications are performed within the set time period.

In one form, after receiving additional structural modifications at 208, each part is cleansed at 210 to remove foreign material. For example, a lubricant may be applied to the blank prior to the solution heat treatment operation or to the stamping die at 204, and is removed at 210. The part is then positioned or, in other words, racked, at 212, with one or more other parts with a gap defined between two adjacent parts. More particularly, in one form, multiple parts may be racked in a fixture (not shown) that is configured to provide a gap between two adjacent parts to prevent the parts from nesting with each other. The fixture is also configured to retain the position of the parts, such that parts are prevented from shifting during subsequent operations. In one form, the fixture may be a stainless steel SMF part rack for optimal heat treating response.

With multiple parts arranged together, the parts undergo an artificial aging treatment to increase the yield strength of the parts, at 214 and a chemical pretreatment, at 216. In one form, the artificial aging treatment is performed in an industrial oven to achieve a high strength temper such as T6 or T7x. For example, for T6 temper, the parts are aged at 110° C. for two-hours and then at 165° C. for another two-hours. Additional details regarding the artificial ageing treatment is provided in U.S. Published Application 2015/0101718, which is incorporated herein by reference. Furthermore, other artificially aging specification/standards may be used, such as those provided by American Society of Metals (ASM) and United States Military Standard (MIL). In one form, the time periods between the stamping and quenching operation of 206 to the artificial aging of 214 is less than 24-hours. That is, the natural aging occurring between these two operations is less than 24-hours.

In one form, for the chemical pretreatment, the batch of parts are dipped in a chemical solution provided in a tank. For example, the fixture holding the parts is immersed in the tank by way of a forklift to allow the parts to be fully coated. The gaps provided between the parts allows the chemical solution to flow between the parts to fully coat each part. The pretreatment may include titanium zirconium, Alodine, or electro-chemical processing to provide stable oxide conversion coating to promote structural adhesive bond strength and durability performance. The chemical pretreatment allows the parts to receive and hold adhesives, paints, or other chemicals that are part of downstream assembly processes. From the chemical pretreatment, the batch of parts are transferred to holding area at 218.

The high volume manufacturing routine 200 may include other processing steps and may perform some of the steps in different sequences. For example, prior to performing the structural modifications at step 208, the stamped parts may undergo a low temperature aging process using, for example, 120° C. for 20 to 60 minutes using a conveyer or roller hearth oven. The low temperature aging process is taken into consideration with respect to the set time period discussed above. In other words, if implemented, the low temperature aging and the structural modifications are to be completed within the set time period (i.e., formability time period). The routine may also include a step for buffering or accumulating parts between the structural modifications and the artificial aging. In another variation, the parts may be racked prior to cleansing. In yet another variation, the batch pretreatment is performed before the artificial aging.

Figure 4:
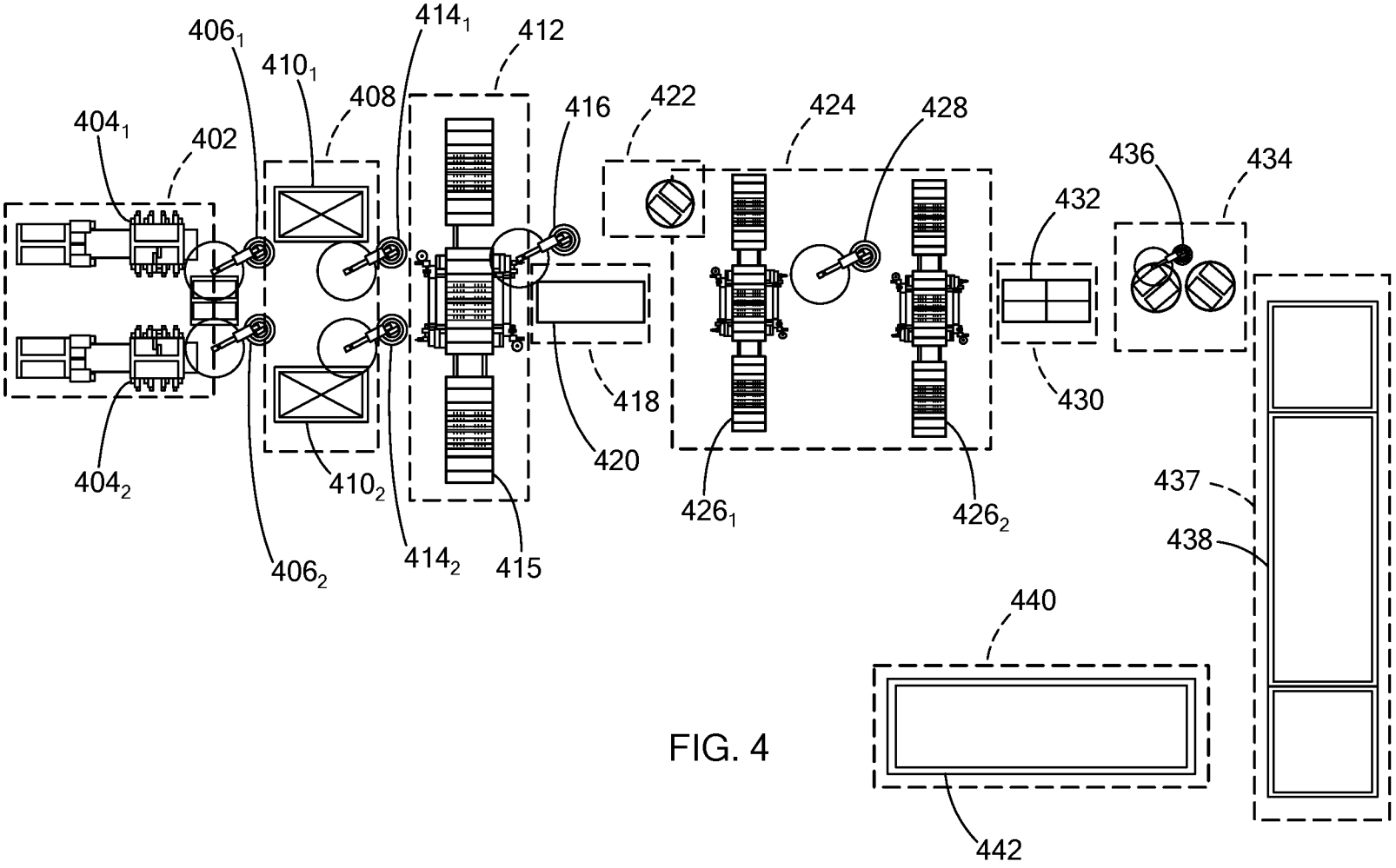
FIG. 4 illustrates an example high volume manufacturing layout for forming high strength aluminum parts in accordance with the teachings of the present disclosure.

Referring to FIG. 4, an example implementation of a high volume manufacturing line based on the teachings of the present disclosure is provided. Section 402 includes two stacks of blanks arranged in parallel and identified as $\mathbf{404}_1$ and $\mathbf{404}_2$. The blanks are destacked, one-by-one, by automated machines $\mathbf{406}_1$ and $\mathbf{406}_2$, respectively. In one form, the automated machines $\mathbf{406}_1$ and $\mathbf{406}_2$ are robotic devices that each move one blank at a time to section 408.

In one form, a solution heat treatment (SHT) operation is performed at section 408. The section 408 includes two stacked convection ovens $\mathbf{410}_1$ and $\mathbf{410}_2$ that are configured to heat multiple blanks at a time. For example, the ovens $\mathbf{410}_1$ and $\mathbf{410}_2$ include multiple shelves for holding multiple blanks, and the automated machines $\mathbf{406}_1$ and $\mathbf{406}_2$ transfer one blank at time to each shelf of a respective ovens $\mathbf{410}_1$ and $\mathbf{410}_2$. Here, the ovens $\mathbf{410}_1$ and $\mathbf{410}_2$ perform the solution heat treatment as discussed above.

From the solution heat treatment operation, the blanks are transferred to section 412 for a stamping-quenching operation, as described above. Automated machines $\mathbf{414}_1$ and $\mathbf{414}_2$ transfer the heated blanks from the ovens $\mathbf{410}_1$ and $\mathbf{410}_2$ to a stamping press 415, where the blank is stamped into a part and rapidly cooled to room temperature. From the stamping press 415, an automated machine 416 transfers the part to section 418 for a low temperature aging operation performed by a conveyer style oven 420. In another form, the low temperature aging operation may be removed and the parts may directly proceed to section 422 or 424 for additional processing.

Section 422 is a holding area for accumulating or buffering parts before the parts enter a series of forming operations in section 424. While not illustrated another automated machine may be used to move the parts from low temperature aging operation to the holding area. In another form, the parts from low temperature aging operation may bypass the holding area and are directly transferred to the series of forming operations of section 424.

Section 424 includes multiple machines $\mathbf{426}_1$ and $\mathbf{426}_2$ that are arranged in series with each other and the stamping press 414 for performing one or more structural modifications on the parts. The machines $\mathbf{426}_1$ and $\mathbf{426}_2$ may include any suitable cutting and/or bending machine for performing one or more structural modifications as described above. In one form, an automated machine 428 transfers the parts from one machine to the other.

From the structural modifications, the parts are cleansed in section 430 by a washer 432, and then racked in section 434 by an automated machined 436. While not illustrated additional automated machines may be used to transfer the parts from machine $\mathbf{426}_2$ to the washer 432, and from the washer 432 to section 434 for racking. Alternatively, the parts could also be manually racked.

After a batch of parts is racked in section 434, the batch is transferred to section 437 for an artificially aging operation performed by a conveyor oven 438. In one form, the batch of parts are transferred by way of a lift operable by operator. In another form, the batch of parts are transferred by an automated machine. From the conveyor oven 438, the batch of parts are transferred to section 440 for a chemical pretreatment. For example, using a lift, the bath of parts is disposed within a tank 442 filled with a chemical solution. After the chemical pretreatment, the batch are removed from the tank 442 and placed in a holding area (not shown).

The manufacturing layout of FIG. 4 is just one example implementation of the high volume manufacturing method of the present disclosure. The layout may be configured in other suitable ways for performing. For example, instead of two stacks of blanks in section 402, one stack may be sufficient based on the time allotted for solution heat treatment, stamping-quenching operation, and the structural modifications. Other suitable variations are also within the scope of the present disclosure.

The high volume manufacturing method/routine of the present disclosure form high strength aluminum parts by using 7xxx-series aluminum alloy. The method minimizes delays between stamping and heat treating parts to ensure the natural aging of the parts does not exceed 24-hrs after the parts are quenched. The method also incorporates room temperature forming after quenching (i.e., structural modifications) within 8-hrs of quenching, cleansing, and chemical pretreatment. Accordingly, the present disclosure outlines a method for forming high strength aluminum parts out of 7xxx series aluminum.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A manufacturing method for forming aluminum parts, the method comprising:

acquiring material blanks;

heating, with a first industrial oven, the material blanks to a solvus temperature of the material;

stamping and quenching the heated material blanks to form a plurality of parts, wherein the plurality of parts are cooled to a second temperature lower than the solvus temperature of the material blanks;

low temperature aging the plurality of parts in a conveyer oven or roller hearth oven;

performing one or more structural modifications on the low temperature aged plurality of parts within a set time period subsequent of the stamping and quenching of the heated material blanks, wherein the set time period is less than or equal to 24 hours;

racking the structurally modified plurality of parts with a gap defined between two adjacent parts;

artificially aging the racked plurality of parts with a second industrial oven; and pretreating the artificially aged plurality of parts with a chemical solution.

2. The method of claim 1, wherein the performing one or more structural modifications of the low temperature aged plurality of parts is performed at room temperature.

3. The method of claim 1, wherein the low temperature aging is for a time between 20 to 60 minutes.

4. The method of claim 1, wherein the one or more structural modifications comprises at least one of trimming, piercing, and bending the low temperature aged plurality of parts.

5. The method of claim 1 further comprising having a plurality of machines positioned in series for the stamping and quenching of the heated material blanks, and for the one or more structural modifications on the low temperature aged plurality of parts.

6. The method of claim 1, wherein the one or more structural modifications is completed within 8 hours after the stamping and quenching of the heated material blanks.

7. The method of claim 1 further comprising cleansing the structurally modified or racked plurality of parts prior to the artificially aging the racked plurality of parts.

8. The method of claim 1, wherein heating the material blanks to a solvus temperature further comprises transferring the material blanks to the first industrial oven.

9. The method of claim 1, wherein the stamping and quenching, the performing one or more structural modifications, and the racking the structurally modified plurality of parts are completed within 24 hours.

10. The method of claim 1, wherein the material blanks are made of 7xxx series aluminum alloy.

* * * * *